US005546621A

United States Patent [19]

Bulot

[11] Patent Number: 5,546,621

[45] Date of Patent: Aug. 20, 1996

[54] ARROW-OUT

[75] Inventor: Carl E. Bulot, P.O. Box 564, Port Sulphur, La. 70083

[73] Assignee: Carl E. Bulot, Port Sulphur, La.

[21] Appl. No.: 394,899

[22] Filed: Feb. 27, 1995

[51] Int. Cl.[6] ..... B25B 13/00

[52] U.S. Cl. ..... 7/138; 7/167; 294/1.1; 140/123

[58] Field of Search ..... 294/1.1, 2; 7/138, 7/167; 81/3.05, 488; 16/114 R; 140/123

[56] References Cited

U.S. PATENT DOCUMENTS 4,656,722 4/1987 Lopez ..... 294/1.1
4,791,701 12/1988 Dutchburn ..... 7/167
5,189,749 3/1993 Thomas et al. ..... 7/138
5,276,928 1/1994 Smith ..... 7/138
5,445,424 8/1995 Binette ..... 294/1.1
5,468,034 11/1995 Kopel ..... 294/1.1

*Primary Examiner*—James G. Smith

[57] ABSTRACT

A compound device for gripping arrows, for easy removal from a target, by means of two pivoting handle sections with an elongated groove in each handle section, with said groove containing rubber nodules which when closed around an arrow shaft form a gripping surface. Located in each handle sections on one end is a broadhead wrench which is comprised of two sections, which when handles are closed form the complete wrench, which is used to remove broadheads from arrow shaft, on the opposite end of one handle section a snap swivel is located as a convenience for carrying purposes.

5 Claims, 1 Drawing Sheet

ARROW-OUT
FIG. 1
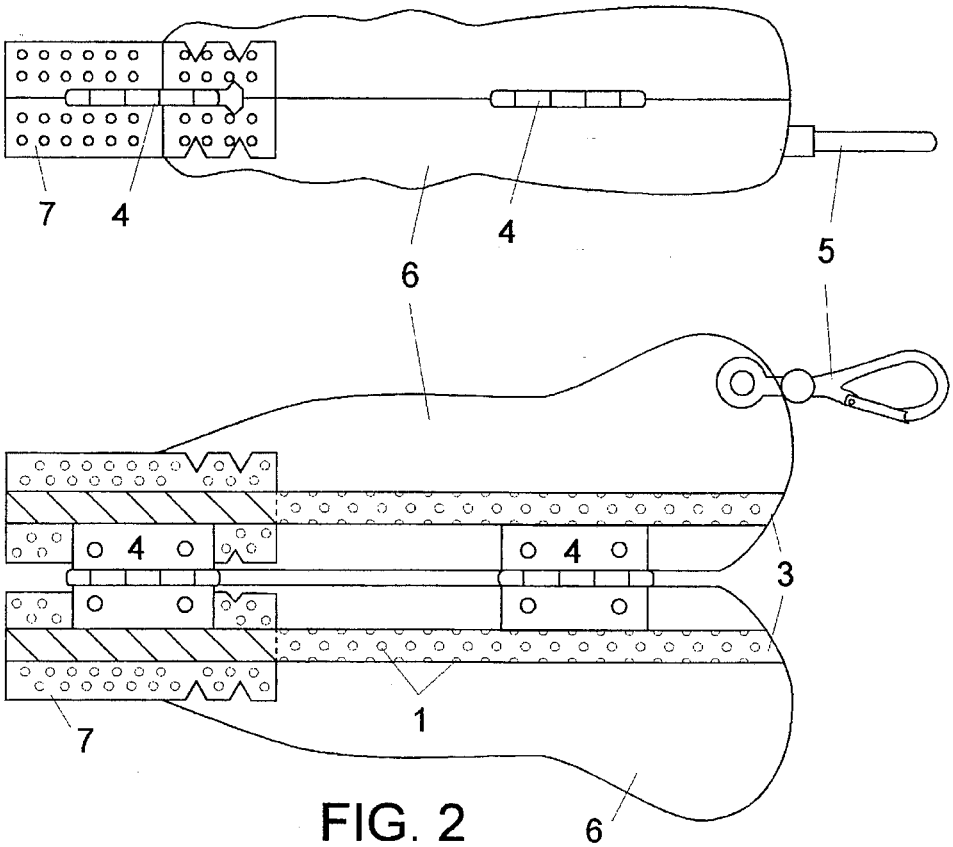
FIG. 2
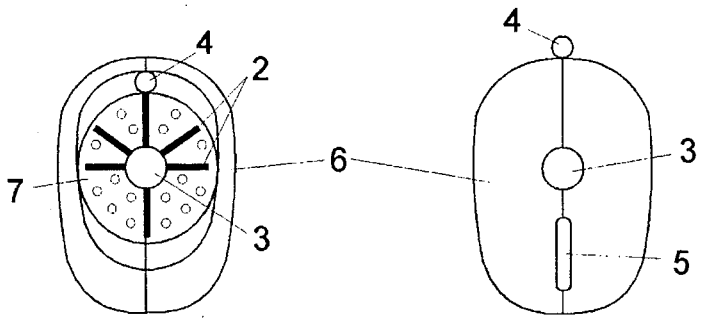
FIG. 3 FIG. 4

ARROW-OUT

FIELD OF INVENTION

This invention relates to the sport of archery, specifically to the removal of arrows from new style 3-D foam targets, and to the removal of broadheads from arrows, when arrows are so armed.

BACKGROUND OF INVENTION

With the sport of archery returning to popularity and with the development of new 3-D style foam targets and more powerful bows, arrow penetration is deeper and the arrow will sometimes penetrate the target completely. This makes arrow removal difficult, more so if arrow is armed with a broadhead.

Some of the problems overcome by Arrow-Out as opposed to prior art U.S. Pat. No. 5,445,424 are:

a) Arrow-Out is a compound tool capable of gripping arrows to remove arrows from a target and also can be used to remove broadheads from said arrows.

b) Arrow-Out's pulling force is applied directly to the horizontal plane of the arrow shaft by the archer, instead of having an offset handle as a gripping device for the archer.

c) Arrow-Out increases the gripping surface of the arrow shaft.

d) There are only two movable pivot points instead of multiple parts ie. springs and jaws, which reduces chances of failure of the device.

Arrow-Out as opposed to prior art U.S. Pat. No. 5,189,749:

a) Arrow-Out is a compound device for gripping and removing arrows from a target and removing broadheads from said arrows.

OBJECT OF INVENTION

It is the object of this invention to provide the archer with a reliable, dual purpose device, which is easy to use and provides an easy means of gripping an arrow shaft for removal from a target as well as a safe convenient way to remove broadhead tipped arrows.

SUMMARY OF INVENTION

In accordance with the objects of the invention there is disclosed a compound device consisting of the following:

a) A gripping device consisting of two matching components forming a handle, said handles having a cylindrical elongated groove with rubber nodules which form a gripping surface around an arrow shaft when said handles are closed; said arrow being a cylindrical elongated shaft of various lengths and circumferences.

b) A broadhead wrench for removal of broadheads from said arrows; broadheads being a tip of an arrow specifically used for hunting, which has multiple cutting edges.

c) A snap swivel; said snap swivel being a device for clipping Invention to archers belt or clothing to provide a means for carrying.

d) Pivoting devices; said pivoting device being any device which allows handle and broadhead segments to be opened and closed.

Thus all of the above listed are combined to form one compound device for gripping arrows and for the removal of broadheads from arrows which are so tipped, which is reliable, durable and easy to use.

BRIEF DESCRIPTION OF DRAWINGS

FIG. 1 is a top plan view in closed position.

FIG. 2 is a sectional view showing device in open position as viewed from the underside.

FIG. 3 is a front plan view in closed position.

FIG. 4 is a rear plan view in closed position.

DESCRIPTION OF PREFERRED EMBODIMENT

FIG. 1 which is a top plan view showing device in a closed position. Location os pivoting device 4, help combine broadhead wrench 7, and handle 6, into a unit which can be opened to accommodate arrow shaft. Pivoting device 4, is preferably constructed of a good grade metal, as the pivoting devices also form the frame of the device. The broadhead wrench 7, is molded out of a plastic material.

FIG. 2 is a sectional view showing device in open position as viewed from the underside. It should be noted at this time that the device only need by opened wide enough to allow placement over the arrow shaft, but is shown here in a fully open position for clarity. Broadhead wrench 7, and pivoting device 4, are joined together during the molding process of broadhead wrench 7, as is pivoting device 4 to handle sections 6. Snap swivel 5, as viewed in FIG. 2 is also joined into one of the handle sections 6, during molding of handles 6. Snap swivel 5, to be constructed of metal.

As seen in FIG. 2, a cylindrical groove 3, with rubber nodules 1 combine to form a gripping surface around an arrow shaft when handle sections 6, are closed by means of hand pressure. The grooves 3, are aligned on the arrow shaft, hand pressure causes the nodules 1, to press against the arrow shaft there-by causing a friction against the shaft, the archer can increase the gripping tension by squeezing the handle sections 6, tighter around the shaft, then proceeding to pull the arrow out of the target by pulling along the horizontal plane the arrow took upon entering the target to remove the arrow. It should be mentioned that it doesn't require a lot of hand pressure to form an unslippable grip on the arrow shaft, that of a firm handshake is usually sufficient.

FIG. 3 is a front plan view in closed position showing arrow groove 3, it should be noted at this time that arrow groove 3, in wrench 7, does not contain rubber nodules 1. FIG. 3 also shows position of slots 2, in wrench 7, to remove broadheads from arrow shaft. In order to remove broadheads archer need only to align slots 2, on wrench 7, to appropriate blades on broadhead and slide wrench 7, over broadhead then proceed to unscrew broadhead from arrow shaft. Broadhead wrench 7, is to be used with device in closed position. Broadhead wrench 7, is designed to remove broadheads of two, three and four blade design.

FIG. 4 is a rear plan view in closed position showing pivoting device 4, arrow groove 3, with rubber nodules not drawn in FIG. 4, and handle sections 6.

The handle sections 6 as viewed in FIGS. 1 & 2 are molded so as to give the archer a comfortable grip and provide for a larger gripping surface as opposed to gripping the arrow shaft bare handed.

The preferred embodiment of the invention has been described in detail. It will be understood that the above described embodiment if for purposes of illustration and that changes may be made thereto without departing from the spirit or scope of the invention.

I claim:

1. A compound tool for gripping an arrow shaft and removing an arrow head comprising:

a first handle section having an elongated groove along a length thereof, said groove having a shaft gripping means thereon;

a second handle section having an elongated groove along a length thereof, said second handle section groove matching said first handle section groove in shape and size;

said first and second handle sections being pivotally attached to one another to allow for gripping of said arrow shaft;

a socket at one end of the handle sections, with each section defining a portion of said socket, to grip arrow head.

2. A Compound tool according to claim 1 wherein said second handle section groove has gripping means thereon.

3. A compound tool according to claim 1 wherein a snap swivel is secured to an opposite end of one of said handle sections.

4. A compound tool according to claim 2 wherein said gripping means on each of said handle sections are nodules made of resilient material.

5. A compound tool according to claim 1 wherein said handle sections are made of rubber.

* * * * *